US012677869B2

(12) United States Patent
Cali et al.

(10) Patent No.: US 12,677,869 B2
(45) Date of Patent: Jul. 14, 2026

(54) AEROSOL-GENERATING DEVICE WITH LEAK PREVENTION

(71) Applicant: PHILIP MORRIS PRODUCTS S.A., Neuchâtel (CH)

(72) Inventors: Ricardo Cali, Mannheim (DE); Teemu Maattanen, Bern (CH); Thomas Salvador, Tiefenbach (DE)

(73) Assignee: Philip Morris Products S.A., Neuchâtel (CH)

( * ) Notice: Subject to any disclaimer, the term of this patent is extended or adjusted under 35 U.S.C. 154(b) by 620 days.

(21) Appl. No.: 17/784,898

(22) PCT Filed: Dec. 16, 2020

(86) PCT No.: PCT/IB2020/062042
§ 371 (c)(1),
(2) Date: Jun. 13, 2022

(87) PCT Pub. No.: WO2021/124160
PCT Pub. Date: Jun. 24, 2021

(65) Prior Publication Data

US 2023/0011373 A1 Jan. 12, 2023

(30) Foreign Application Priority Data

Dec. 17, 2019 (EP) ..... 19217084

(51) Int. Cl.
*A24F 1/30* (2006.01)

(52) U.S. Cl.
CPC ..... *A24F 1/30* (2013.01)

(58) Field of Classification Search
CPC ..... A24F 1/30
See application file for complete search history.

(56) References Cited

U.S. PATENT DOCUMENTS 859,399 A * 7/1907 Martin ..... F16K 15/04 137/533.15
1,249,984 A * 12/1917 Meissner ..... A24F 1/30 131/173

(Continued)

FOREIGN PATENT DOCUMENTS

DE 102014116824 A1 * 5/2016 ..... A24F 1/30
DE 202016105366 8/2017

(Continued)

OTHER PUBLICATIONS

Espacenet English Translation of DE 102014116824 (Year: 2024).*

(Continued)

*Primary Examiner* — Russell E Sparks
(74) *Attorney, Agent, or Firm* — Mueting Raasch Group

(57) ABSTRACT

An aerosol-generating device has a receptacle configured to receive an aerosol-generating substrate; a heating element configured to heat the aerosol-generating substrate; a power supply operably coupled to the heating element; a vessel comprising an interior configured to contain liquid; and a conduit in fluid communication with the vessel and the receptacle. A valve may be positioned between the conduit and an airflow outlet of the receptacle. The aerosol-generating device may have a tilt detector configured to detect tilting of the device, and a controller configured to shut off power to electrical components.

18 Claims, 4 Drawing Sheets

(56) References Cited

U.S. PATENT DOCUMENTS

| | | | | |
|---|---|---|---|---|
| 4,638,815 | A | 1/1987 | Yoshioka | |
| 5,458,106 | A | 10/1995 | Kim | |
| 8,983,282 | B2 * | 3/2015 | Bishara | A24F 1/30 131/173 |
| 10,244,791 | B2 * | 4/2019 | Cameron | B05B 12/12 |
| 10,820,626 | B2 * | 11/2020 | Benjamignan | A24F 1/30 |
| 12,302,947 | B2 * | 5/2025 | Qiu | A24F 40/46 |
| 2013/0292551 | A1 * | 11/2013 | Chou | H03K 17/78 250/214 SW |
| 2016/0158782 | A1 * | 6/2016 | Henry, Jr. | A24F 40/53 700/275 |
| 2018/0110938 | A1 * | 4/2018 | Trzecieski | A61L 9/00 |
| 2018/0317544 | A1 * | 11/2018 | Hagen | A24F 1/30 |
| 2019/0142061 | A1 | 5/2019 | Haddad | |
| 2019/0166915 | A1 | 6/2019 | Nagata et al. | |
| 2020/0360629 | A1 * | 11/2020 | Zhou | A24B 15/16 |

FOREIGN PATENT DOCUMENTS

| | | | | |
|---|---|---|---|---|
| DE | 102017001555 | | 8/2018 | |
| EP | 3037119 | A1 | 6/2016 | |
| EP | 3494810 | A2 | 6/2019 | |
| JP | S62-4999 | U | 1/1987 | |
| JP | S6443713 | A | 2/1989 | |
| JP | 2000350662 | A | 12/2000 | |
| JP | 2018-500994 | A | 1/2018 | |
| WO | WO-2016019573 | A1 * | 2/2016 | A24F 1/30 |
| WO | 20170080545 | | 5/2017 | |
| WO | WO-2017178932 | A1 * | 10/2017 | A24F 1/30 |
| WO | 20180073742 | | 4/2018 | |
| WO | 20190016737 | | 1/2019 | |
| WO | WO 2019/016737 | A1 | 1/2019 | |
| WO | WO 2018/025380 | A1 | 4/2019 | |

OTHER PUBLICATIONS

Machine Translation of WO 2016/019573 (Year: 2025).*

European Search Report for EP 19217084.3 issued by the European Patent Office Jun. 15, 2020; 9 pgs.

International Search Report and Written Opinion for PCT/IB2020/062042, issued by the European Patent Office; May 21, 2021; 16 pgs.

International Preliminary Report on Patentability for PCT/IB2020/062042, issued Jun. 30, 2022; 9 pages.

JP Office action for JP 2022-535836 issued by the Japanese Patent Office on Nov. 25, 2024; 8 pgs. including English translation.

Chinese Office Action for CN 202080081456.9 issued by the China National Intellectual Property Administration on Mar. 20, 2025; 29 pgs. including English translation.

* cited by examiner

AEROSOL-GENERATING DEVICE WITH LEAK PREVENTION

This application is the § 371 U.S. National Stage of International Application No. PCT/IB2020/062042, filed 16 Dec. 2020, which claims the benefit of European Application No. 19217084.3, filed 17 Dec. 2019.

This disclosure relates to aerosol-generating devices comprising a valve configured to prevent, or at least reduce leaks from the vessel of the device. This disclosure relates to aerosol-generating devices comprising a tilt sensor. This disclosure relates to aerosol-generating devices comprising a tilt sensor and a system for preventing or minimizing spills or leaks.

Traditional shisha devices are used to smoke tobacco and are configured such that vapor and smoke pass through a water basin before inhalation by a consumer. Shisha devices may include one outlet, or more than one outlet so that the device may be used by more than one consumer at a time. Use of shisha devices is considered by some to be a leisure activity and a social experience.

Typically, traditional shishas are used in combination with a substrate, sometimes referred to in the art as hookah tobacco, tobacco molasses, or simply as molasses. Traditional shisha substrates are relatively high in sugar (in some cases, up to ~50% vs. the ~20% typically found in conventional tobacco substrates, such as in combustible cigarettes). The tobacco used in shisha devices may be mixed with other ingredients to, for example, increase the volume of the vapor and smoke produced, to alter flavor, or both.

Traditional shisha devices employ charcoal, such as charcoal pellets to heat and sometimes combust the tobacco substrate to generate an aerosol for inhalation by a user. Using charcoal to heat the tobacco may cause full or partial combustion of the tobacco or other ingredients. Additionally, charcoal may generate harmful or potentially harmful products, such as carbon monoxide, which may mix with the shisha vapor and pass through the water basin to the outlet.

One way to reduce the production of carbon monoxide and combustion by-products is to employ e-liquids rather than tobacco. Shisha devices that employ e-liquids eliminate combustion by-products but deprive shisha consumers of the traditional tobacco-based experience.

Other shisha devices have been proposed that employ electric heaters to heat, but not combust, tobacco. Such electrically heated heat-not-burn shisha devices heat the tobacco substrate to a temperature sufficient to produce an aerosol from the substrate without combusting the substrate, and therefore reduce or eliminate by-products associated with combustion of tobacco.

Shisha devices may employ a cartridge for housing an aerosol-forming substrate. The cartridge may be filled with such aerosol-forming substrate. The aerosol-forming substrate may comprise tobacco, preferably shisha substrate, such as molasses—a mixture of tobacco, water, sugar, and other components, such as glycerine, flavors, etc. The heating system of the electrically heated shisha device heats the contents of the cartridge to generate aerosol, which is conveyed through an airflow path to a user.

In order to facilitate airflow through the cartridge and the flow of the aerosol from the cartridge, a shisha cartridge may have one or more holes through one or more walls. The cartridge may include one or more holes at the top, one or more holes at the bottom, or both one or more holes at the top and one or more holes at the bottom. The holes may also be disposed along the sides of the cartridge. Alternatively, the top may be open, that is, the top wall may be partially or completely absent. Any holes or openings in the top and bottom walls may be closed by a removable (for example, peelable) sealing layer, such as a film, sticker, or liner, during storage. The removable layer may protect the contents (for example, the molasses) from exposure to air and oxygen. The removable layer may be removed (for example, pulled or peeled off) by a user prior to first use of the cartridge.

The holes or openings in the cartridge, if left unsealed, may lead to loss of freshness (for example, moisture content) or contamination of the substrate, as well as issues with leakage. For one or more reasons, such as in order to maintain freshness, to prevent leakage of the substrate, or to preserve the quality and integrity of the substrate during storage, it is desirable to close or seal the openings or holes of the cartridge prior to use or between uses if the entire contents of the cartridge are not used at once.

Aerosol-generating devices, such as shisha devices, typically comprise a vessel containing liquid, and a conduit in fluid communication with the vessel and the receptacle for housing the aerosol-forming substrate. Electrically heated shisha devices typically also comprise a heating element and a power supply operably coupled to the heating element.

It would be desirable to provide an aerosol-generating device capable of preventing or reducing leaks or spills when the device is tilted (for example, falls). It would be desirable to provide an aerosol-generating device capable of preventing or reducing leaks or spills into the electronic components of the device. It would be desirable to provide an aerosol-generating device capable of detecting when the device is tilted. It would be desirable to provide an aerosol-generating device capable of preventing operation of the heating element when tilting of the device is detected. It would be desirable to provide an aerosol-generating device capable of shutting off power to the heating element or other electronics when tilting of the device is detected.

According to another embodiment of the present disclosure, the aerosol-generating device may comprise a receptacle configured to receive an aerosol-generating substrate, a heating element configured to heat the aerosol-generating substrate, and a power supply operably coupled to the heating element. The device may comprise a vessel comprising an interior configured to contain liquid, a conduit in fluid communication with the vessel and the receptacle, and a valve positioned between the conduit and an airflow outlet of the receptacle. The valve may be configured to prevent egress of liquid from the interior of the vessel through the valve. The valve may be a one-way valve that is open from the receptacle to the vessel and closed from the vessel to the receptacle. The valve may be in an open position when the device is upright and in a closed position when the device is tilted. The valve may be positioned at an airflow outlet (for example, airflow outlet of the receptacle). The valve may be positioned at a stem pipe inlet. The aerosol-generating device may comprise a tilt sensor configured to sense a tilt of the device and to send a signal when tilting is sensed, and a controller configured to receive a signal from the tilt sensor and to control the electrical components in response to the signal. The controller may shut off power to the heating element.

According to another embodiment of the present disclosure, the aerosol-generating device comprises a receptacle configured to receive an aerosol-generating substrate, a heating element configured to heat the aerosol-generating substrate, and a power supply operably coupled to the heating element. The device comprises a vessel comprising an interior configured to contain liquid, a conduit in fluid communication with the vessel and the receptacle, and a valve positioned between the conduit and an airflow outlet of the receptacle. The valve is configured to prevent egress of liquid from the interior of the vessel through the valve.

The valve may be a one-way valve that is open from the receptacle to the vessel and closed from the vessel to the receptacle. The valve may be in an open position when the device is upright and in a closed position when the device is tilted. The valve may be positioned at an airflow outlet (for example, airflow outlet of the receptacle). The valve may be positioned at a stem pipe inlet. The aerosol-generating device may comprise a tilt sensor configured to sense a tilt of the device and to send a signal when tilting is sensed, and a controller configured to receive a signal from the tilt sensor and to control the electrical components in response to the signal. The controller may shut off power to the heating element.

According to another embodiment of the present disclosure, an aerosol-generating device may comprise a receptacle configured to receive an aerosol-generating substrate, a heating element configured to heat the aerosol-generating substrate, a power supply operably coupled to the heating element, and a vessel comprising an interior configured to contain liquid. The aerosol-generating device may further comprise a controller and a tilt sensor. The tilt sensor may be configured to sense a tilt of the device and to send a signal to the controller when tilting is sensed. The controller may be configured to receive the signal from the tilt sensor and to control the electrical components in response to the signal. The controller may be configured to shut off power to the heating element in response to the signal.

According to another embodiment of the present disclosure, an aerosol-generating device comprises a receptacle configured to receive an aerosol-generating substrate, a heating element configured to heat the aerosol-generating substrate, a power supply operably coupled to the heating element, and a vessel comprising an interior configured to contain liquid. The aerosol-generating device further comprises a controller and a tilt sensor configured to sense a tilt of the device and to send a signal to the controller when tilting is sensed. The controller is configured to receive the signal from the tilt sensor and to control the electrical components in response to the signal. The controller may be configured to shut off power to the heating element in response to the signal.

According to an embodiment of the present invention, the aerosol-generating device comprises a receptacle configured to receive an aerosol-generating substrate, a heating element configured to heat the aerosol-generating substrate, and a power supply operably coupled to the heating element. The device comprises a vessel comprising an interior configured to contain liquid, a conduit in fluid communication with the vessel and the receptacle, and a valve positioned between the conduit and an airflow outlet of the receptacle. The valve is configured to prevent egress of liquid from the interior of the vessel through the valve. The valve may be a one-way valve that allows aerosol to flow from the receptacle to the vessel but does not allow liquid to flow from the vessel to the receptacle.

The valve may be in an open position when the device is upright and in a closed position when the device is tilted. The valve may be positioned at an airflow outlet (for example, the airflow outlet of the receptacle). The valve may be positioned at a stem pipe inlet. The valve may be positioned at an airflow outlet of the vessel (for example, at a hose connection). The aerosol-generating device may comprise a tilt sensor configured to sense a tilt of the device and to send a signal when tilting is sensed. The aerosol-generating device may comprise a controller configured to receive a signal from the tilt sensor and to control the electrical components in response to the signal. The controller may be configured to shut off power to the heating element.

The aerosol-generating device may be capable of preventing or at least reducing leaks or spills when the device is tilted (for example, falls). The aerosol-generating device may be safe to use because it is capable of preventing or reducing leaks or spills into the electronic components of the device. The aerosol-generating device may be capable of detecting when the device is tilted. The aerosol-generating device may be capable of preventing operation of the heating element and other electrical components when there is a risk of liquid leaking onto the electrical components.

Various embodiments of the present disclosure relate to aerosol-generating devices comprising a valve configured to prevent, or at least reduce leaks from the vessel of the device. Some embodiments of the present disclosure relate to aerosol-generating devices comprising a tilt sensor. Some embodiments of the present disclosure relate to aerosol-generating devices comprising a tilt sensor and a system for preventing spills or leaks.

The term "aerosol" is used herein to refer to a suspension of solid particles or liquid droplets or a combination of solid particles and liquid droplets in a gas. The gas may be air. The solid particles or liquid droplets may comprise one or more volatile flavor compounds. Aerosol may be visible or invisible. Aerosol may include vapors of substances that are ordinarily liquid or solid at room temperature. Aerosol may include vapors of substances that are ordinarily liquid or solid at room temperature, in combination with solid particles or in combination with liquid droplets or in combination with both solid particles and liquid droplets. In some embodiments, the aerosol comprises nicotine.

The term "aerosol-forming substrate" is used herein to refer to a material capable of releasing one or more volatile compounds that can form an aerosol. In some embodiments, an aerosol-forming substrate may be heated to volatilize one or more components of the aerosol-forming substrate to form an aerosol. As an alternative to heating or combustion, in some cases volatile compounds may be released by a chemical reaction or by a mechanical stimulus, such as ultrasound. The aerosol-forming substrate may be disposed inside the cartridge. Aerosol-forming substrate may be solid or liquid or may comprise both solid and liquid components. Aerosol-forming substrate may be adsorbed, coated, impregnated or otherwise loaded onto a carrier or support. Aerosol-forming substrate may comprise nicotine.

Aerosol-forming substrate may comprise plant-based material. Aerosol-forming substrate may comprise tobacco. Aerosol-forming substrate may comprise a tobacco-containing material containing volatile tobacco flavor compounds, which are released from the aerosol-forming substrate upon heating. Aerosol-forming substrate may alternatively comprise a non-tobacco-containing material. Aerosol-forming substrate may comprise homogenized plant-based material. Aerosol-forming substrate may comprise homogenized tobacco material.

Aerosol-forming substrate may comprise at least one aerosol-former. Aerosol-forming substrate may comprise other additives and ingredients, such as flavorants.

The terms "integral" and "integrally formed" are used herein to describe elements that are formed in one piece (a single, unitary piece). Integral or integrally formed components may be configured such that they cannot be separably removed from each other without causing structural damage to the piece.

The term "electrical component" is used here to describe a part of the device that conducts, provides, or uses electricity in its operation. Examples of electrical components are power sources, heating elements, electrical wires, resistors, capacitors, controller parts, and the like.

The term "upright position" is used here to describe a position of the device where a longitudinal axis of the device is vertical or normal to a horizontal plane. According to an embodiment, when the device is upright, the vessel is positioned below the receptacle.

The terms "tilt" and "tilting" are used here to describe angled positions of the device that differ from its upright position. For example, the device may be considered tilted if the longitudinal axis of the device is angled 10° or more from the longitudinal axis in an upright position.

As used herein, the singular forms "a," "an," and "the" also encompass embodiments having plural referents, unless the content clearly dictates otherwise.

As used herein, "or" is generally employed in its sense including "one or the other or both" unless the content clearly dictates otherwise.

The term "about" is used herein in conjunction with numeric values to include normal variations in measurements as expected by persons skilled in the art, and is understood to have the same meaning as "approximately." The term "about" understood to cover a typical margin of error. A typical margin of error may be, for example, ±5% of the stated value.

As used herein, "have," "having," "include," "including," "comprise," "comprising" or the like are used in their open-ended sense, and generally mean "including, but not limited to". It will be understood that "consisting essentially of," "consisting of," and the like are subsumed in "comprising," and the like.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure, including the claims.

The term "substantially" as used herein has the same meaning as "significantly," and can be understood to modify the term that follows by at least about 90%, at least about 95%, or at least about 98%. The term "not substantially" as used herein has the same meaning as "not significantly," and can be understood to have the inverse meaning of "substantially," i.e., modifying the term that follows by not more than 10%, not more than 5%, or not more than 2%.

Any direction referred to herein, such as "top," "bottom," "left," "right," "upper," "lower," and other directions or orientations are described herein for clarity and brevity but are not intended to be limiting of an actual device or system. Devices and systems described herein may be used in a number of directions and orientations.

The present disclosure relates to aerosol-generating devices capable of preventing or reducing leaks or spills of the liquid contained in the vessel of the device. The present disclosure relates to aerosol-generating devices capable of preventing or reducing leaks or spills of the liquid into the electronic components of the device, such as the heating element, controller, power supply, or a combination thereof. The present disclosure relates to aerosol-generating devices comprising a valve configured to prevent or at least reduce leaks from the vessel of the device. The present disclosure also relates to aerosol-generating devices comprising a tilt sensor. The device may be configured to prevent or reduce spills or leaks when a tilt is sensed. The device may be configured to shut off power to electrical components when a tilt is sensed. The aerosol-generating device may be configured to prevent operation of the heating element and other electrical components when there is a risk of liquid leaking onto the electrical components.

In certain embodiments, the aerosol-generating device comprises one or more valves positioned between the vessel configured to contain liquid and electronic components of the device. For example, the aerosol-generating device may comprise one or more valves positioned between the vessel and the heating element, the vessel and the power supply, or the vessel and both the heating element and power supply. The valve may be configured to prevent egress of liquid from the interior of the vessel through the valve.

In some embodiments, the aerosol-generating device comprises a tilt sensor configured to sense a tilt of the device. The tilt sensor may be configured to send a signal when tilting is sensed. The aerosol-generating device may comprise a controller configured to receive the signal from the tilt sensor, and to control the electrical components in response to the signal.

For example, the controller may shut off power to the heating element.

According to an embodiment, the aerosol-generating device comprises a receptacle configured to receive an aerosol-generating substrate, a heating element configured to heat the aerosol-generating substrate, and a power supply operably coupled to the heating element. The device comprises a vessel comprising an interior configured to contain liquid and a conduit in fluid communication with the vessel and the receptacle. According to an embodiment, the aerosol-generating device comprises at least one valve positioned between the conduit and an airflow outlet of the receptacle. For example, the valve may be positioned at the inlet of the conduit. The valve may be configured to prevent egress of liquid from the interior of the vessel through the valve. The valve may be configured to prevent liquid from the interior of the vessel from entering the receptacle. The valve may be configured to prevent liquid from the interior of the vessel from reaching the heating element. The valve may be configured to prevent liquid from the interior of the vessel from reaching the power supply. The valve may be configured to prevent liquid from the interior of the vessel from reaching the controller. The valve may be configured to prevent liquid from the interior of the vessel from reaching the electronic components of the device.

According to an embodiment, the vessel is in fluid communication with the receptacle via the conduit when the device is upright. According to an embodiment, when the device is upright, the vessel is positioned below the receptacle. The valve may be configured to close the fluid communication between the vessel and the receptacle when the device is tilted. For example, the valve may be in an open position when the device is upright and in a closed position when the device is tilted. In some embodiments, the aerosol-generating device comprises a one-way valve that is open from the receptacle to the vessel and closed from the vessel to the receptacle.

The valve may be in a closed position when the device is tilted 10° or greater, 15° or greater, 20° or greater, 25° or greater, 30° or greater, 35° or greater, 45° or greater, 60° or greater, or 75° or greater from an upright position.

The valve may comprise a ball valve. The valve may comprise a ball valve that closes when tilted 10° or greater, 15° or greater, 20° or greater, 25° or greater, 30° or greater, 35° or greater, 45° or greater, 60° or greater, or 75° or greater from an upright position.

In some embodiments, the valve may be a smart valve configured to detect when the device is tilted and to perform an action when a tilt is detected. For example, the valve may send a signal to the controller when a tilt is detected. For example, in some embodiments, the smart valve may comprise a ball valve. The ball valve may comprise a ball and a seat and the smart valve may be configured to detect whether the ball is positioned in the seat.

In some embodiments, the valve comprises a tilt sensor. The tilt sensor may comprise an emitter to emit an electromagnetic beam and a detector to detect the electromagnetic beam.

The tilt sensor may comprise a blocking member configured to block the electromagnetic beam when the device is tilted. The blocking member may be a ball of a ball valve. The tilt sensor may comprise a seat configured to receive the ball when the device is in an upright position. The tilt sensor may be configured to detect when the ball is seated in the seat.

The aerosol-generating device may be a shisha device, and the conduit may comprise a stem pipe extending from the receptacle to the vessel. The valve may be configured to prevent liquid from the vessel from entering the receptacle through the stem pipe.

The valve may be positioned at an aerosol inlet. For example, the valve may be positioned at an inlet of the stem pipe. The valve may be positioned at the airflow outlet of the receptacle. The valve is preferably positioned between the airflow outlet of the receptacle and the airflow inlet of the stem pipe.

In some embodiments, the device comprises two or more valves. One valve may be positioned at the inlet of the stem pipe. Another valve may be positioned at the outlet of the stem pipe.

The aerosol-generating device may comprise a controller and a tilt sensor configured to sense a tilt of the device and to send a signal when tilting is sensed. The controller may be configured to receive a signal from the tilt sensor and to control the electrical components in response to the signal. The controller may be configured to shut off power to the heating element in response to the signal.

According to an embodiment, the aerosol-generating device comprises a receptacle configured to receive an aerosol-generating substrate, a heating element configured to heat the aerosol-generating substrate, a power supply operably coupled to the heating element, a vessel comprising an interior configured to contain liquid, and a system configured to protect the electronic components of the device from leaks and spills. The system may comprise a controller and a tilt sensor configured to sense a tilt of the device and to send a signal to the controller when tilting is sensed.

The aerosol-generating device may have a threshold tilt, such as 10° or greater, 15° or greater, 20° or greater, 25° or greater, 30° or greater, 35° or greater, 45° or greater, 60° or greater, or 75° or greater from the upright position. The tilt sensor may be configured to send a signal to the controller when the angle $\alpha$ of the aerosol-generating device greater than the threshold tilt. For example, the tilt sensor may be configured to send a signal when the device is tilted 10° or more, 15° or more, 20° or more, 25° or more, 30° or more, 35° or more, 40° or more, 45° or more, 60° or more, or 75° or more. The tilt sensor may be operably coupled with the controller. In some embodiments, the tilt sensor is coupled via an electrical connection, a data connection, or both an electrical connection and a data connection to the controller. The tilt sensor may send the signal via the electrical or data connection or may send a wireless signal to the controller.

The controller may be operably coupled with the power supply. The controller may be operably coupled with the heating element. The controller may be configured to receive the signal from the tilt sensor and to control the electrical components in response to the signal.

For example, the controller may be configured to prevent operation of the electronic components of the device, such as the heating element, controller, power supply, or a combination thereof, upon receiving the signal. The controller may be configured to shut off power to the electronic components of the device, such as the heating element, controller, power supply, or a combination thereof, upon receiving the signal.

The tilt sensor may comprise at least one gyroscope. The tilt sensor may comprise at least one accelerometer. The tilt sensor may comprise at least one gyroscope and at least one accelerometer. The tilt sensor may comprise any other device capable of assessing the position (for example, deviation from an upright position) of the device. The tilt sensor may comprise an emitter to emit an electromagnetic beam and a detector to detect the electromagnetic beam. In some embodiments, the tilt sensor may be part of a valve (for example, a smart valve). The tilt sensor may comprise a blocking member configured to block the electromagnetic beam when the device is tilted. The blocking member may be a ball of a ball valve.

A method for using the aerosol-generating device may comprise placing an aerosol-generating substrate into the receptacle and placing liquid into the vessel. The method may comprise turning on the aerosol-generating device. Turning on of the aerosol-generating device may comprise turning on a heating element. A power supply operably coupled to the heating element may provide power to the heating element.

The aerosol-generating device may comprise a tilt sensor configured to sense a tilt of the device. The aerosol-generating device may comprise a controller operably coupled to the tilt sensor and the electrical components. The method of using the aerosol-generating device may comprise receiving a signal from the tilt sensor indicating that the device is tilted and shutting off one or more of the electrical components in response to the signal. The tilt sensor may be configured to send a signal when the device is tilted 10° or more, 15° or more, 20° or more, 25° or more, 30° or more, 35° or more, 40° or more, 45° or more, 60° or more, or 75° or more.

The aerosol-generating device may comprise a valve configured to prevent egress of liquid from the interior of the vessel when the device is tilted. The valve may be a one-way valve that allows aerosol to flow from the receptacle to the vessel but does not allow liquid to flow from the vessel to the receptacle. The valve may be in an open position when the device is upright and in a closed position when the device is tilted. The valve may be positioned at an aerosol inlet (for example, stem pipe). The valve may be positioned at a stem pipe inlet.

According to an embodiment of the method, the valve prevents liquid in the vessel from reaching one or more electrical components of the device when the device is tilted.

According to an embodiment of the present disclosure, the aerosol-generating device may comprise a receptacle configured to receive an aerosol-generating substrate. The aerosol-generating substrate may be provided inside a cartridge. The cartridge may be heatable with the heating element of the aerosol-generating device.

The cartridge may comprise any suitable body defining a cavity. Aerosol-forming substrate may be disposed in the cavity of the cartridge. The body is preferably formed from one or more heat resistant materials, such as a heat resistant metal or polymer. The body may comprise a thermally conductive material. For example, the body may comprise any of aluminum, copper, zinc, nickel, silver, any alloys thereof, and combinations thereof.

Preferably, the body comprises aluminum.

The cartridge may be of any suitable shape. For example, the cartridge may have a shape configured to be received by an aerosol-generating device. The cartridge may have a substantially cuboidal shape, cylindrical shape, frustoconical shape, or any other suitable shape. Preferably, the cartridge has a generally cylindrical shape or a frustoconical shape.

The aerosol-generating device is configured to heat the aerosol-forming substrate in the cartridge. The device may be configured to heat the aerosol-forming substrate in the cartridge by conduction. The cartridge is preferably shaped and sized to allow contact with, or minimize distance from, a heating element of the aerosol-generating device to provide efficient heat transfer from the heating element to the aerosol-forming substrate in the cartridge. The heat may be generated by any suitable mechanism, such as by resistive heating or by induction. In order to facilitate inductive heating, the cartridge may be provided with a susceptor. For example, the cartridge body may be made from or include a material (for example, aluminum) that is capable of acting as a susceptor, or a susceptor material may be provided within the cavity of the cartridge. A susceptor material may be provided within the cavity of the cartridge in any form, for example a powder, a solid block, shreds, etc.

Any suitable aerosol-forming substrate may be provided in the cavity defined by the body of the cartridge. The aerosol-forming substrate is preferably a substrate capable of releasing volatile compounds. The aerosol-forming substrate is preferably a substrate capable of releasing compounds that may form an aerosol. The volatile compounds may be released by heating the aerosol-forming substrate. The volatile compounds may be released by a chemical reaction or by a mechanical stimulus, such as ultrasound. Aerosol-forming substrate may be solid or liquid or may comprise both solid and liquid components. Aerosol-forming substrate may be adsorbed, coated, impregnated or otherwise loaded onto a carrier or support.

The aerosol-forming substrate may comprise nicotine. The nicotine containing aerosol-forming substrate may comprise a nicotine salt matrix. The aerosol-forming substrate may comprise plant-based material. The aerosol-forming substrate preferably comprises tobacco.

The tobacco containing material preferably comprises volatile tobacco flavor compounds, which are released from the aerosol-forming substrate upon heating. The aerosol-forming substrate may comprise homogenized tobacco material. Homogenized tobacco material may be formed by agglomerating particulate tobacco. The aerosol-forming substrate may alternatively or additionally comprise a non-tobacco-containing material. The aerosol-forming substrate may comprise homogenized plant-based material. Aerosol-forming substrate may comprise at least one aerosol-former. Aerosol-forming substrate may comprise other additives and ingredients, such as flavorants. Preferably, the aerosol-forming substrate is a shisha substrate. A shisha substrate is understood to mean a consumable material that is suitable for use in a shisha device. Shisha substrate may include molasses.

The aerosol-forming substrate may include, for example, one or more of: powder, granules, pellets, shreds, spaghettis, strips, or sheets. The aerosol-forming substrate may contain one or more of: herb leaf, tobacco leaf, fragments of tobacco ribs, reconstituted tobacco, homogenized tobacco, extruded tobacco, and expanded tobacco.

The aerosol-forming substrate may include at least one aerosol former. Suitable aerosol formers include compounds or mixtures of compounds which, in use, facilitate formation of a dense and stable aerosol and which are substantially resistant to thermal degradation at the operating temperature of the aerosol-generating device. Suitable aerosol formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Particularly preferred aerosol formers are polyhydric alcohols or mixtures thereof, such as triethylene glycol, 1,3-butanediol and, most preferred, glycerine. The aerosol-forming substrate may include any suitable amount of an aerosol former. For example, the aerosol former content of the substrate may be equal to or greater than 5% on a dry weight basis, and preferably greater than 30% by weight on a dry weight basis. The aerosol former content may be less than about 95% on a dry weight basis. Preferably, the aerosol former content is up to about 55%.

The aerosol-forming substrate preferably includes nicotine and at least one aerosol former.

In some embodiments, the aerosol former is glycerine or a mixture of glycerine and one or more other suitable aerosol formers, such as those listed above.

The aerosol-forming substrate may include other additives and ingredients, such as flavorants, sweeteners, etc. In some examples, the aerosol-forming substrate includes one or more sugars in any suitable amount. Preferably, the aerosol-forming substrate includes invert sugar. Invert sugar is a mixture of glucose and fructose obtained by splitting sucrose.

Preferably, the aerosol-forming substrate includes from about 1% to about 40% sugar, such as invert sugar, by weight. In some example, one or more sugars may be mixed with a suitable carrier such as cornstarch or maltodextrin.

In some examples, the aerosol-forming substrate includes one or more sensory-enhancing agents. Suitable sensory-enhancing agents include flavorants and sensation agents, such as cooling agents. Suitable flavorants include natural or synthetic menthol, peppermint, spearmint, coffee, tea, spices (such as cinnamon, clove, ginger, or combination thereof), cocoa, vanilla, fruit flavors, chocolate, eucalyptus, geranium, eugenol, agave, juniper, anethole, linalool, and any combination thereof.

In some examples, the aerosol-forming substrate is in the form of a suspension. For example, the aerosol-forming substrate may include molasses. As used herein, "molasses" means an aerosol-forming substrate composition comprising about 20% or more sugar. For example, the molasses may include at least about 25% by weight sugar, such as at least about 35% by weight sugar. Typically, the molasses will contain less than about 60% by weight sugar, such as less than about 50% by weight sugar.

Any suitable amount of aerosol-forming substrate (for example, molasses or tobacco substrate) may be disposed in the cavity. In some preferred embodiments, about 3 g to about 25 g of the aerosol-forming substrate is disposed in the cavity. The cartridge may include at least 6 g, at least 7 g, at least 8 g, or at least 9 g of aerosol-forming substrate. The cartridge may include up to 15 g, up to 12 g; up to 11 g, or up to 10 g of aerosol-forming substrate. Preferably, from about 7 g to about 13 g of aerosol-forming substrate is disposed in the cavity.

The aerosol-forming substrate may be provided on or embedded in a thermally stable carrier. The term "thermally stable" is used herein to indicate a material that does not substantially degrade at temperatures to which the substrate is typically heated (e.g., about 150° C. to about 300° C.). The carrier may comprise a thin layer on which the substrate deposited on a first major surface, on second major outer surface, or on both the first and second major surfaces. The carrier may be formed of, for example, a paper, or paper-like material, a non-woven carbon fiber mat, a low mass open mesh metallic screen, or a perforated metallic foil or any other thermally stable polymer matrix. Alternatively, the carrier may take the form of powder, granules, pellets, shreds, spaghettis, strips or sheets. The carrier may be a non-woven fabric or fiber bundle into which tobacco components have been incorporated. The non-woven fabric or fiber bundle may comprise, for example, carbon fibers, natural cellulose fibers, or cellulose-derivative fibers.

The body of the cartridge may include one or more walls. In some embodiments, the body includes a top wall, a bottom wall, and a sidewall. The sidewall may be cylindrical or frustoconical, extending from the bottom to the top. The body may include one or more parts.

For example, the sidewall and the bottom wall may be an integral single part. The sidewall and the bottom wall may be two parts configured to engage one another in any suitable manner. For example, the sidewall and the bottom wall may be configured to engage one another by threaded engagement or interference fit. The sidewall and the bottom wall may be two parts joined together. For example, the sidewall and the bottom wall may be joined together by welding or by an adhesive. The top wall and sidewall may be a single integral part. The sidewall and the top wall may be two parts configured to engage one another in any suitable manner. For example, sidewall and the top wall may be configured to engage one another by threaded engagement or interference fit. The sidewall and the top wall may be two parts joined together. For example, the sidewall and the top wall may be joined together by welding or by an adhesive. The top wall, sidewall and bottom wall may all be a single integral part. The top wall, the sidewall, and the bottom wall may be three separate parts configured to engage one another in any suitable manner. For example, the top wall, the sidewall, and the bottom wall may be configured to engage by threaded engagement interference fit, welding, or an adhesive.

One or more walls of the body may form a heatable wall or surface. As used herein, "heatable wall" and "heatable surface" mean an area of a wall or a surface to which heat may be applied, either directly or indirectly. The heatable wall or surface may function as a heat transfer surface through which heat may be transferred from outside of the body to the cavity or to an internal surface of the cavity.

Preferably, the body of the cartridge has a length (for example, an axial length along a vertical center axis) of about 15 cm or less. In some embodiments, the body has a length of about 10 cm or less. The body may have an inside diameter of about 1 cm or more. The inside diameter of the body may be about 1.75 cm or more. The cartridge may have a heatable surface area in the cavity from about 25 $cm^2$ to about 100 $cm^2$, such as from about 70 $cm^2$ to about 100 $cm^2$. The volume of the cavity may be from about 10 $cm^3$ to about 50 $cm^3$; preferably from about 25 $cm^3$ to about 40 $cm^3$. In some embodiments, the body has a length in a range from about 3.5 cm to about 7 cm. The inside diameter of the body may be from about 1.5 cm to about 4 cm. The body may have a heatable surface area in the cavity from about 30 $cm^2$ to about 100 $cm^2$, such as from about 70 $cm^2$ to about 100 $cm^2$. The volume of the cavity may be from about 10 $cm^3$ to about 50 $cm^3$; preferably from about 25 $cm^3$ to about 40 $cm^3$. Preferably, the body is cylindrical or frustoconical.

The cartridge body may include one or more openings or ventilation holes through one or more walls of the body. The ventilation holes may be inlets, outlets, or both. The ventilation holes may be disposed at the bottom wall, top wall, sides, or a combination thereof, of the cartridge. In some embodiments, the cartridge includes one or more inlets and one or more outlets to allow air to flow through the aerosol-forming substrate when the cartridge is used with an aerosol-generating device. In some embodiments, the top wall of the cartridge may be absent or may define one or more openings to form the one or more inlets of the cartridge. The bottom wall of the cartridge may define one or more openings to form the one or more outlets of the cartridge. Preferably, the one or more inlets and outlets are sized and shaped to provide a suitable resistance to draw (RTD) through the cartridge. In some examples, the RTD through the cartridge, from the inlet or inlets to the outlet or outlets, may be from about 10 mm $H_2O$ to about 50 mm $H_2O$, preferably from about 20 mm $H_2O$ to about 40 mm $H_2O$. The RTD of a specimen refers to the static pressure difference between the two ends of the specimen when it is traversed by an air flow under steady conditions in which the volumetric flow is 17.5 milliliters per second at the output end. The RTD of a specimen may be measured using the method set out in ISO Standard 6565:2002.

The one or more openings on the body may cover 5% or greater, 10% or greater, 15% or greater, 20% or greater, or 25% or greater of the area of the wall the openings are on. For example, if the openings are on the top wall, the openings may cover at least 5% of the area of the top wall. The one or more openings on the body may cover 75% or less, 50% or less, 40% or less, or 30% or less of the area of the wall the openings are on.

The cartridge may further include a seal or layer covering the one or more inlets and optionally a second seal or layer covering the one or more outlets prior to use. The cartridge may include a first removable seal covering the one or more inlets and a second removable seal covering the one or more outlets. The first and second seals are preferably sufficient to prevent air flow through the inlets and outlets to prevent leakage of the contents of the cartridge and to extend shelf life. The seal may comprise a peelable label of sticker, foil, or the like. The label, sticker, or foil may be affixed to the cartridge in any suitable manner, such as with an adhesive, crimping, welding, or otherwise being joined to the container. The seal may comprise a tab that may be grasped to peel or remove the label, sticker, or foil from the cartridge.

In some embodiments, the aerosol-generating device is a shisha device. The cartridge may be a shisha cartridge. Preferably, the shisha device is configured to sufficiently heat the aerosol-forming substrate in the cartridge to form an aerosol from the aerosol-forming substrate but not to combust the aerosol-forming substrate. For example, the shisha device may be configured to heat the aerosol-forming substrate to a temperature in a range from about 150° C. to about 300° C.; more preferably from about 180° C. to about 250° C. or from about 200° C. to about 230° C.

The shisha device may include a receptacle for receiving the cartridge. The shisha device may include a heating element configured to contact or to be in proximity to the body of the cartridge when the cartridge is received in the receptacle. The heating element may form at least part of the receptacle. For example, the heating element may form at least a portion of the surface of the receptacle. The shisha cartridge may be configured to transfer heat from the heating element to the aerosol-forming substrate in the cavity by conduction. In some embodiments, the heating element includes an electric heating element. In some embodiments, the heating element includes a resistive heating component. For example, the heating element may include one or more resistive wires or other resistive elements. The resistive wires may be in contact with a thermally conductive material to distribute heat produced over a broader area. Examples of suitable conductive materials include aluminum, copper, zinc, nickel, silver, and combinations thereof. The heating element may form at least a portion of the surface of the receptacle.

The aerosol-generating device may include control electronics operably coupled to the heating element. The control electronics may be configured to control heating of the heating element. The control electronics may be configured to control the temperature to which the aerosol-forming substrate in the cartridge is heated. The control electronics may be provided in any suitable form and may, for example, include a controller or a memory and a controller.

The controller may include one or more of an Application Specific Integrated Circuit (ASIC) state machine, a digital signal processor, a gate array, a microprocessor, or equivalent discrete or integrated logic circuitry. Control electronics may include memory that contains instructions that cause one or more components of the circuitry to carry out a function or aspect of the control electronics. Functions attributable to control electronics in this disclosure may be embodied as one or more of software, firmware, and hardware.

The electronic circuitry may include a microprocessor, which may be a programmable microprocessor. The electronic circuitry may be configured to regulate a supply of power.

The power may be supplied to the heater element in the form of pulses of electrical current.

In some examples, the control electronics may be configured to monitor the electrical resistance of the heating element and to control the supply of power to the heating element depending on the electrical resistance of the heating element. In this manner, the control electronics may regulate the temperature of the resistive element.

The aerosol-generating device may include a temperature sensor, such as a thermocouple.

The temperature sensor may be operably coupled to the control electronics to control the temperature of the heating element. The temperature sensor may be positioned in any suitable location. For example, the temperature sensor may be configured to insert into the cartridge when received within the receptacle to monitor the temperature of the aerosol-forming substrate being heated. In addition or alternatively, the temperature sensor may be in contact with the heating element. In addition or alternatively, the temperature sensor may be positioned to detect temperature at an airflow outlet of the aerosol-generating device or a portion thereof. The sensor may transmit signals regarding the sensed temperature to the control electronics. The control electronics may adjust heating of the heating elements in response to the signal to achieve a suitable temperature at the sensor.

The control electronics may be operably coupled to a power supply. The aerosol-generating device may include any suitable power supply. For example, the power supply may comprise a battery or set of batteries. The batteries of the power supply may be rechargeable, removable and replaceable, or rechargeable and removable and replaceable. Any suitable battery may be used. For example, heavy duty type or standard batteries existing in the market, such as used for industrial heavy-duty electrical power-tools. Alternatively, the power supply may be any type of electric power supply including a super or hyper-capacitor.

Alternatively, the assembly may be connected to an external electrical power source, and electrically and electronically designed for such purpose. Regardless of the type of power supply employed, the power supply preferably provides sufficient energy for the normal functioning of the assembly for at least one shisha session until aerosol is depleted from the aerosol-forming substrate in the cartridge before being recharged or needing to connect to an external electrical power source. Preferably, the power supply provides sufficient energy for the normal functioning of the assembly for at least about 70 minutes of continuous operation of the device, before being recharged or needing to connect to an external electrical power source.

In some embodiments, the aerosol-generating device includes an aerosol-generating element that includes a cartridge receptacle, a heating element, an airflow outlet, and an air inlet. The cartridge receptacle is configured to receive a cartridge according to the present disclosure containing the aerosol-forming substrate. The heating element may define at least part of a surface of the receptacle.

The aerosol-generating device includes an air inlet channel in fluid connection with the receptacle. In use, when the substrate inside the cartridge is heated, aerosol former components in the substrate vaporize. Air flowing from the air inlet channel through the cartridge becomes entrained with aerosol generated from the aerosol former components in the cartridge.

The air inlet channel may include one or more apertures through the cartridge receptacle such that air from outside the aerosol-generating device may flow through the channel and into the cartridge receptacle through the one or more apertures. If a channel includes more than one aperture, the channel may include a manifold to direct air flowing through the channel to each aperture.

As described above, the cartridge includes one or more openings (such as inlets or outlets) formed in the body, allowing air to flow through the cartridge. If the receptacle includes one or more inlet apertures, at least some of the inlets in the cartridge may align with the apertures in the top of the receptacle. The cartridge may include an alignment feature configured to mate with a complementary alignment feature of the receptacle to align the inlets of the cartridge with the apertures of the receptacle when the cartridge is inserted into the receptacle.

Air that enters the cartridge may flow across or through, or both across and through the aerosol-forming substrate, entraining aerosol, and exiting the cartridge and receptacle via an airflow outlet. From the airflow outlet, the air carrying the aerosol enters a vessel of the aerosol-generating device via the stem pipe.

The aerosol-generating device may include any suitable vessel defining an interior volume configured to contain a liquid and defining an outlet in the headspace above a liquid fill level.

The vessel may include an optically transparent or opaque housing to allow a consumer to observe contents contained in the vessel. The vessel may include a liquid fill demarcation, such as a liquid fill line. The vessel housing may be formed of any suitable material. For example, the vessel housing may include glass or suitable rigid plastic material. Preferably, the vessel is removable from a portion of the aerosol-generating assembly comprising the aerosol-generation element to allow a consumer to fill, empty or clean the vessel.

The vessel may be filled to a liquid fill level by a consumer. The liquid preferably includes water, which may optionally be infused with one or more colorants, flavorants, or colorants and flavorants. For example, the water may be infused with one or both of botanical and herbal infusions.

Aerosol entrained in air exiting the airflow outlet of the receptacle may travel through a conduit positioned in the vessel. The conduit may be coupled to the airflow outlet of the aerosol-generating element and may have an opening below the liquid fill level of the vessel, such that aerosol flowing through the vessel flows through the opening of the conduit, then through the liquid, into headspace of the vessel and exits through a headspace outlet, for delivery to a consumer.

The headspace outlet may be coupled to a hose comprising a mouthpiece for delivering the aerosol to a consumer. The mouthpiece may include an activation element, such as a switch activatable by a user, a puff sensor arranged to detect a user puffing on the mouthpiece, or both a switch activatable by the user and a puff sensor. The activation element is operably coupled to the control electronics of the aerosol-generating device. The activation element may be wirelessly coupled to the control electronics. Activation of the activation element may cause the control electronics to activate the heating element, rather than constantly supplying energy to the heating element. Accordingly, the use of an activation element may serve to save energy relative to devices not employing such elements to provide on-demand heating rather than constant heating.

For purposes of example, one method for using the aerosol-generating device (for example, a shisha device) as described herein is provided below in chronological order. The vessel may be detached from other components of the shisha device and filled with water. One or more of natural fruit juices, botanicals, and herbal infusions may be added to the water for flavoring. The amount of liquid added should cover a portion of the conduit but should not exceed a fill level mark that may optionally exist on the vessel. The vessel is then reassembled to the shisha device. The cartridge may be prepared by removing any removable layer (if present). A portion of the aerosol-generating element may be removed or opened to allow the cartridge to be inserted into the receptacle. The aerosol-generating element is then reassembled or closed. The device may then be turned on. Turning on the device may initiate a heating profile of a heating element, to heat the aerosol-forming substrate to a temperature at or above a vaporization temperature but below a combustion temperature of the aerosol-forming substrate. The aerosol forming compounds of the aerosol-forming substrate vaporize, generating an aerosol. The user may puff on the mouthpiece as desired. The user may continue using the device as long as desired or until no more aerosol is visible or being delivered. In some embodiments, the device may be arranged to automatically shut off when the cartridge or a compartment of the cartridge is depleted of usable aerosol-forming substrate. In some embodiments, the consumer may refill the device with a fresh cartridge after, for example, receiving the cue from the device that the aerosol-forming substrate in the cartridge is depleted or nearly depleted. If the shisha device is tilted past its threshold tilt, the tilt sensor may detect the tilt and send a signal to the controller. The controller may shut off power to the electrical components of the device. The shisha device may be turned off at any time by a consumer by, for example, switching off the device.

The shisha device may have any suitable air management. In one example, puffing action from the user will create a suction effect causing a low pressure inside the device which will cause external air to flow through an air inlet of the device, into the air inlet channel, and into the receptacle. The air may then flow through the cartridge in the receptacle and become entrained with aerosol produced from the aerosol-forming substrate. The air with entrained aerosol then exits the airflow outlet of the receptacle, flows through the conduit to the liquid inside the vessel. The aerosol will then bubble out of the liquid and into head space in the vessel above the level of the liquid, out the headspace outlet, and through the hose and mouthpiece for delivery to the consumer. The flow of external air and the flow of the aerosol inside the shisha device may be driven by the action of puffing from the user.

Reference will now be made to the drawings, which depict one or more embodiments described in this disclosure. However, it will be understood that other embodiments not depicted in the drawings fall within the scope and spirit of this disclosure. Like numbers used in the figures refer to like components. The use of different numbers to refer to components in different figures is not intended to indicate that the different numbered components cannot be the same or similar to other numbered components. The figures are presented for purposes of illustration and not limitation. Schematic drawings presented in the figures are not necessarily to scale.

Figure 1:
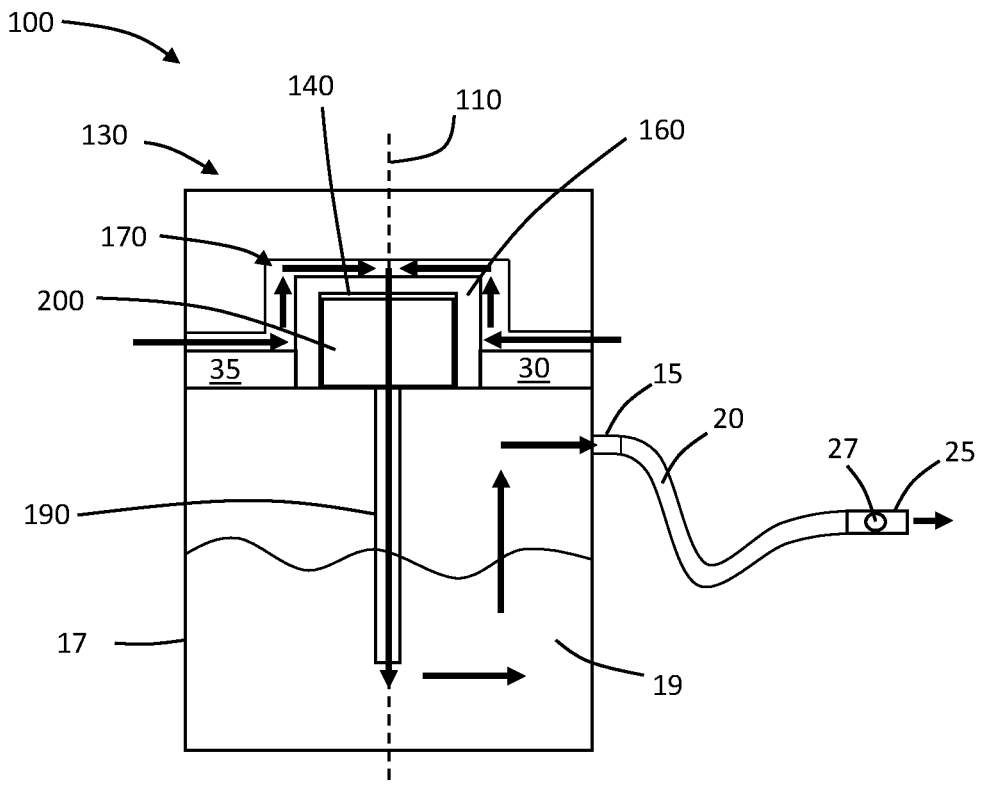
FIG. 1 is a schematic view of a shisha device.

FIG. 1 is a schematic sectional view of an example of an aerosol-generating device 100 (for example, a shisha device). The device 100 includes a vessel 17 defining an interior volume configured to contain liquid 19 and defining a headspace outlet 15 above a fill level for the liquid 19. The liquid 19 preferably includes water, which may optionally be infused with one or more colorants, one or more flavorants, or one or more colorants and one or more flavorants. For example, the water may be infused with one or both of botanical infusions and herbal infusions. The device 100 has a longitudinal axis 110. When the device 100 is in an upright position, the longitudinal axis 110 is substantially vertical.

The device 100 also includes an aerosol-generating element 130. The aerosol-generating element 130 includes a receptacle 140 configured to receive a cartridge 200 comprising an aerosol-forming substrate. The aerosol-generating element 130 may also include a heating element 160. The heating element 160 may form at least one surface of the receptacle 140. In the depicted embodiment, the heating element 160 defines the side surfaces of the receptacle 140. The aerosol-generating element 130 also includes an air inlet channel 170 that draws air into the device 100. In some embodiments, portion of the air inlet channel 170 is formed by the heating element 160 to heat the air before the air enters the receptacle 140. The pre-heated air then enters the cartridge 200, which is also heated by heating element 160, to carry aerosol generated by the aerosol former and the aerosol-forming substrate. The air exits an outlet of the aerosol-generating element 130 and enters a conduit 190. The conduit 190 carries the air and aerosol into the vessel 17 below the level of the liquid 19. The air and aerosol may bubble through the liquid 19 and exit the headspace outlet 15 of the vessel 17. A hose 20 may be attached to the headspace outlet 15 to carry the aerosol to the mouth of a user. A mouthpiece 25 may be attached to, or form a part of, the hose 20. An exemplary air flow path of the device, in use, is depicted by thick arrows in FIG. 1. The mouthpiece 25 may include an activation element 27. The activation element 27 may be a switch, button or the like, or may be a puff sensor or the like. The activation element 27 may be placed at any other suitable location of the device 100. The activation element 27 may be in wireless communication with the controller 30 to place the device 100 in condition for use or to cause controller to activate the heating element 160; for example, by causing power supply 35 to energize the heating element 160.

The controller 30 and power supply 35 may be located in any suitable position of the aerosol-generating element 130, including locations other than the bottom portion of the element 130 as depicted in FIG. 1.

Figure 2A:
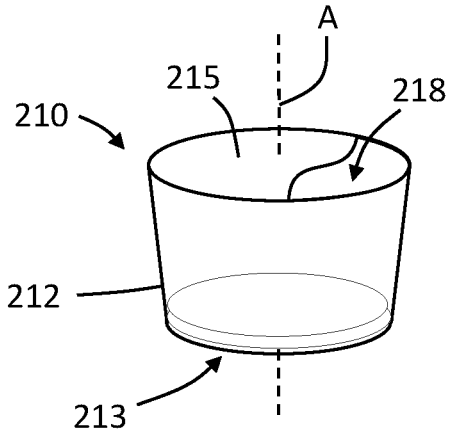
FIGS. 2A and 2B are schematic side and bottom perspective views, respectively, of the body of a shisha cartridge for use in the shisha device of FIG. 1.
Figure 2B:
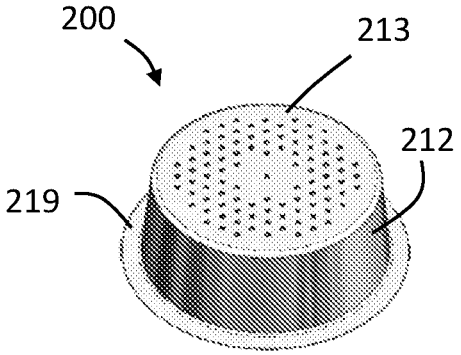

Referring now to FIGS. 2A and 2B, various views of the cartridge body 210 are shown. The cartridge body 210 may include a side wall 212, a top wall 215, and a bottom wall 213 defining a cavity 218. The side wall 212 may be cylindrical or frustoconical, as shown. FIG. 2A shows the cartridge body 210 with a portion of the top 215 removed, showing the cavity 218 inside the body. The body 210 may define a center axis A extending through the cartridge body 210. The top may comprise a flange 219 that extends from the sidewall 212 as shown in FIG. 2B. The flange 219 may rest on shoulder of a receptacle of a shisha device so that cartridge 200 may be readily removed from the receptacle after use by grasping the flange.

Figure 3:
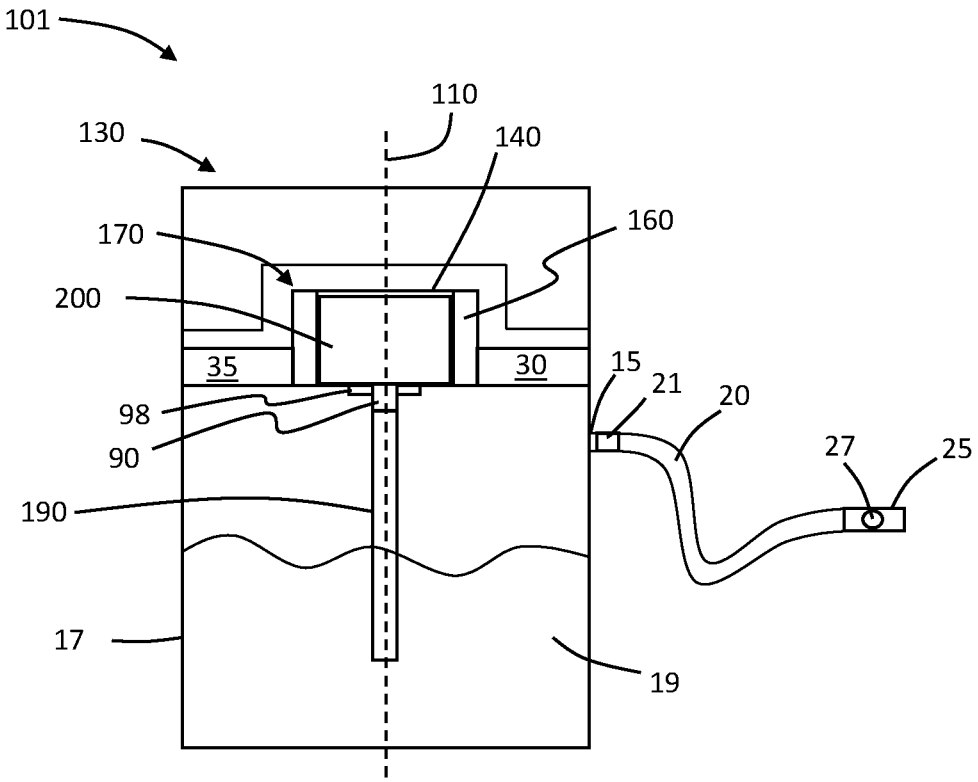
FIG. 3 is a schematic view of an aerosol-generating device according to an embodiment.

An aerosol-generating device 101 according to an embodiment of the present disclosure is shown in FIG. 3. The aerosol-generating device 101 is generally similar to the aerosol-generating device 100 of FIG. 1 and additionally comprises at least one valve. As shown, the aerosol-generating device 101 comprises a valve 90. The valve 90 may be positioned at the aerosol inlet of the stem pipe 190. The valve 90 may be positioned between the receptacle 140 and the stem pipe 190. The valve 90 may be a one-way valve configured to allow aerosol to pass from the cartridge 200 to the stem pipe 190, while preventing liquid 19 from passing from the vessel 17 to the aerosol-generating element 130. The aerosol-generating device 101 may further comprise a seal 98. The seal 98 may be disposed adjacent the valve 90. The seal 98 may be configured to further help prevent or reduce leaks of liquid 19 into the aerosol-generating element 130.

The device 101 has a longitudinal axis 110. When the device 101 is in an upright position, the longitudinal axis 110 is substantially vertical.

The aerosol-generating device 101 may optionally comprise one or more additional valves 21, for example, at the outlet 15 connecting to the hose 20. The additional valves 21 may be configured to allow aerosol to pass through. The additional valves 21 may be configured to prevent liquid from passing through. In some embodiments, the additional valves 21 may be configured to be in an open position when the aerosol-generating device 101 is upright and in a closed position when the aerosol-generating device 101 is tilted. The additional valves 21 may be configured to be in a closed position if the aerosol-generating device 101 falls on its side. The additional valves 21 may comprise, for example, a ball valve.

Figure 4:
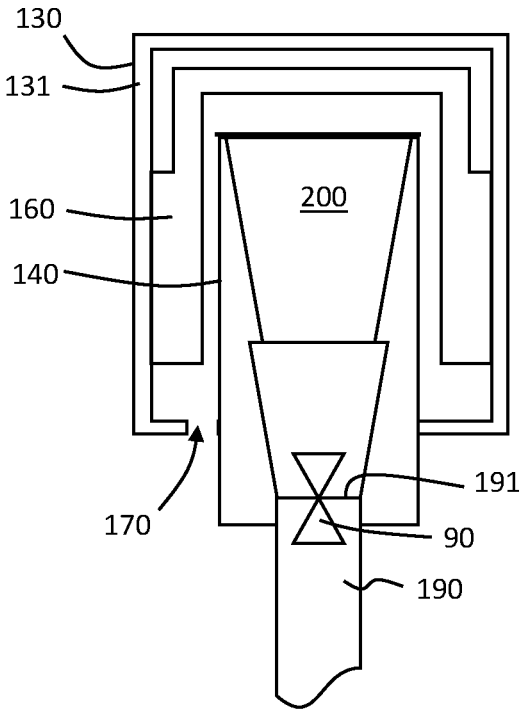
FIG. 4 is a partial schematic cross-sectional view of a top portion of the aerosol-generating device of FIG. 3 according to an embodiment.

A cross sectional view of the top portion of the aerosol-generating device 101 is shown in FIG. 4. As discussed with regard to FIG. 1 above, the top portion of the aerosol-generating device 101 may comprise an aerosol-generating element 130. The aerosol-generating element 130 may comprise a cap (not shown) removably placeable on the aerosol-generating device 101. The aerosol-generating element 130 may comprise a housing 131 configured to house at least the heating element 160 and a receptacle 140 for receiving the cartridge 200. According to an embodiment, the valve 90 is positioned below the aerosol-generating element 130. For example, the valve 90 may be positioned directly below the receptacle 140. In some embodiments, the valve 90 is positioned at the airflow inlet end 191 of the stem pipe 190. The valve 90 may be a one-way valve that is open from the receptacle to the vessel and closed from the vessel to the receptacle. The valve 90 may have an open position and a closed position. For example, the valve 90 may be in the open position when the device is upright and in the closed position when the device is tilted. The valve 90 may be a smart valve configured to detect when the device is tilted and to perform an action when a tilt is detected. For example, the valve 90 may send a signal to a controller when a tilt is detected.

Figure 5A:
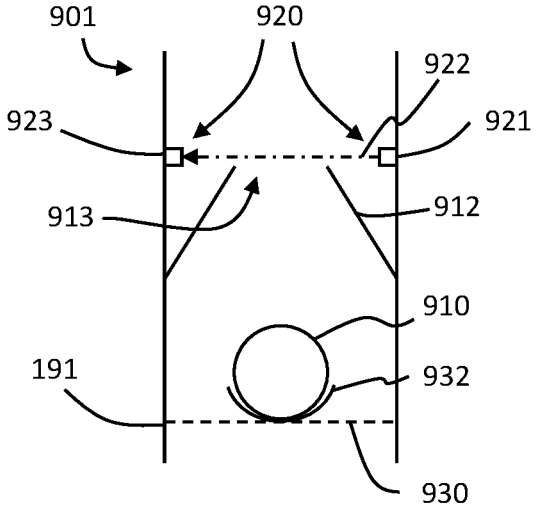
FIGS. 5A and 5B are schematic cross-sectional views of a valve and tilt sensor of the aerosol-generating device of FIG. 3 according to an embodiment.
Figure 5B:
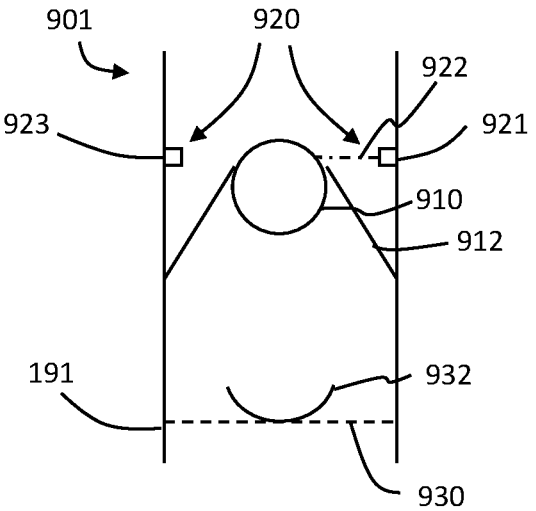

In some embodiments, the aerosol-generating device 101 comprises a valve with a sensor capable of detecting if the aerosol-generating device 101 is tilted. A schematic detail view of a valve 901 comprising a sensor 920 is shown in FIGS. 5A and 5B. The valve 901 may be disposed in the stem pipe 190 or at an end (for example, the airflow inlet end 191) of the stem pipe 190. Alternatively or in addition, the valve 901 may be disposed at the outlet 15. The valve 901 may by a ball valve comprising a ball 910 and a valve seat 912. The valve seat 912 may be positioned upstream of the ball 910 during normal operation of the aerosol-generating device 101. The valve seat 912 may have a valve opening 913 that is smaller than the diameter of the ball 910. When the aerosol-generating device 101 is tilted (for example, falls on its side), the ball 910 becomes seated in the valve seat 912 and blocks the valve opening 913.

The valve 901 may comprise a sensor 920 constructed to detect whether the ball 910 is seated in the valve seat 912. For example, the sensor 920 may comprise an emitter 921 and a detector 923. The emitter 921 may be configured to emit a signal or beam 922 that can be detected by the detector 923. For example, the emitter 921 may be configured to emit an electromagnetic ray (for example, a beam of light) that can be detected by the detector 923. When the ball 910 is not seated in the valve seat 912, as shown in FIG. 5A, the beam 922 reaches the detector 923. When the aerosol-generating device 101 is tilted (for example, falls on its side), the ball 910 may become seated in the valve seat 912 and blocks the beam 922 as shown in FIG. 5B. The detector 923 is capable detecting the blocking of the beam 922 and may be configured to send a signal to a controller. In response to the signal, the controller may shut off powder to one or more electronic components of the aerosol-generating device 101.

The valve 901 may comprise a porous plate 930. The porous plate 930 may support the ball 910 when the ball 910 is not seated in the valve seat 912. The porous plate 930 may be configured to allow aerosol and liquid to pass through. When the aerosol-generating device 101 is tilted (for example, falls on its side), liquid may flow through the porous plate 930 and push the ball 910 toward the valve seat 912. The ball 910 may be made of a material that is denser than the liquid 19 in the vessel 17 so that the ball 910 sinks when submerged in the liquid 19.

The valve 901 may comprise a rest seat 932 for the ball 910. The rest seat 932 may be disposed on top of the porous plate 930. The rest seat 932 may be configured to maintain the ball 910 in place when the aerosol-generating device 101 is upright, for example during normal operation.

Figure 6:
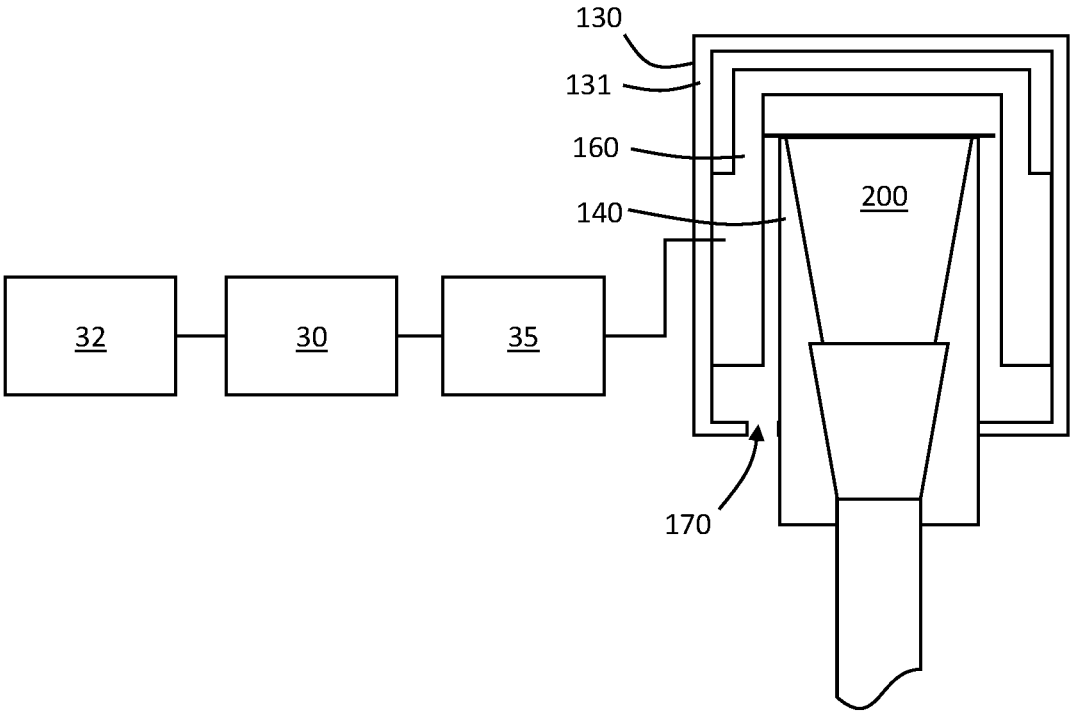
FIG. 6 is a partial schematic view of a top portion of the aerosol-generating device of FIG. 1 according to an embodiment.
Figure 7:
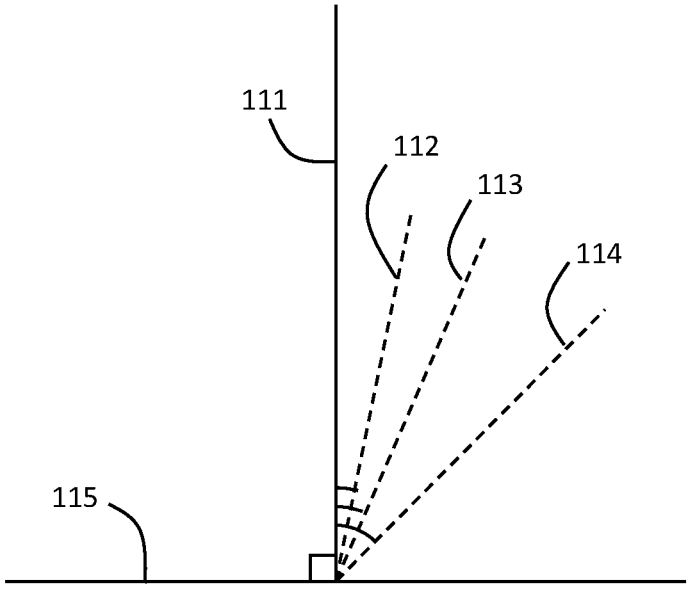
FIG. 7 is a graphical representation of a tilt position of the aerosol-generating device of FIG. 3 according to an embodiment.

Referring now to FIG. 6, a partial schematic of an aerosol-generating device 101 with a tilt sensor 32 is shown. The aerosol-generating device 100 may comprise a system configured to protect the electronic components of the device from leaks and spills. The system may comprise a tilt sensor 32 and a controller 30. The tilt sensor 32 may be configured to detect the position of the aerosol-generating device 100. For example, the tilt sensor 32 may comprise an accelerometer, a gyroscope, or another device capable of assessing the position (for example, deviation from an upright position) of the device. The tilt position is graphically demonstrated in FIG. 7. The ordinary or upright position 111 of the aerosol-generating device 100 is normal (perpendicular) to a horizontal plane 115. The longitudinal axis 110 aerosol-generating device 100 may be tilted by any angle 112, 113, 114, etc., as shown.

The tilt sensor 32 may be configured to send a signal to the controller when the aerosol-generating device 100 is tilted. The aerosol-generating device 100 may have a threshold tilt, such as 10° or greater, 15° or greater, 20° or greater, 25° or greater, 30° or greater, 35° or greater, 45° or greater, 60° or greater, or 75° or greater from the upright position. The tilt sensor 32 may be configured to send a signal to the controller when the angle $\alpha$ of the aerosol-generating device 100 is greater than the threshold tilt. The tilt sensor 32 may be operably coupled with the controller 30. In some embodiments, the tilt sensor 32 is coupled via an electrical connection, a data connection, or both an electrical connection and a data connection to the controller 30. The tilt sensor 32 may send the signal via the electrical or data connection or may send a wireless signal to the controller 30. The controller 30 may be operably coupled with the power supply 35. In some embodiments, the controller 30 may be configured to control the operation of the power supply 35. For example, the controller 30 may shut off power to the electrical components (for example, the heating element 160) of the aerosol-generating device 100 upon receiving a signal from the tilt sensor 32.

Thus, aerosol-generating devices capable of preventing or reducing leaks are described. Various modifications and variations of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are apparent to those skilled in the mechanical arts, chemical arts, and aerosol-generating article manufacturing or related fields are intended to be within the scope of the following claims.

The invention claimed is:

1. An aerosol-generating device comprising:

a receptacle configured to receive an aerosol-generating substrate;

electrical components comprising:

a heating element configured to heat the aerosol-generating substrate; and a power supply operably coupled to the heating element;

a vessel comprising an interior configured to contain liquid, wherein the vessel is positioned below the receptacle when the device is upright;

a conduit in fluid communication with the vessel and the receptacle; and a valve positioned at an aerosol inlet of the conduit, wherein the valve is configured to prevent egress of liquid from the interior of the vessel through the valve, wherein moving the aerosol-generating device to a vertical position causes the valve to open itself and the vessel to be in fluid communication with the receptacle, and wherein moving the aerosol-generating device to a tilted position causes the valve to close itself and to close fluid communication between the vessel and the receptacle.

2. The aerosol-generating device according to claim 1, wherein the valve is constructed to be in a closed position when the device is tilted 15° or greater from a vertically upright position.

3. The aerosol-generating device according to claim 1, wherein the valve comprises a ball valve.

4. The aerosol-generating device according to claim 3, wherein the ball valve comprises a ball and a seat configured to receive the ball, and a sensor configured to determine whether the ball is seated in the seat.

5. The aerosol-generating device according to claim 4, wherein the sensor comprises an emitter configured to emit a signal or beam and a detector configured to detect the signal or beam.

6. The aerosol-generating device according to claim 1, wherein the valve comprises a tilt sensor.

7. The aerosol-generating device according to claim 1, wherein the valve is positioned between the vessel and the electrical components.

8. The aerosol-generating device according to claim 1, wherein the device is a shisha device and the conduit comprises a stem pipe extending from the receptacle to the vessel, and wherein the valve is configured to prevent liquid from the vessel from entering the receptacle through the stem pipe.

9. The aerosol-generating device according to claim 1, wherein the aerosol-generating device comprises a second valve, positioned at an airflow outlet of the conduit.

10. The aerosol-generating device according to claim 1, further comprising:

a controller; and a tilt sensor configured to sense a tilt of the device and to send a signal to the controller, when tilting is sensed, wherein the controller is configured to receive the signal from the tilt sensor and to control the electrical components in response to the signal.

11. The aerosol-generating device according to claim 10, wherein the controller is configured to shut off power to the heating element in response to the signal.

12. The aerosol-generating device according to claim 10, wherein the tilt sensor comprises:

an emitter to emit an electromagnetic beam;

a detector to detect the electromagnetic beam; and a blocking member configured to block the electromagnetic beam when the device is tilted.

13. The aerosol-generating device according to claim 10, wherein the tilt sensor comprises:

at least one gyroscope;

at least one accelerometer; or at least one gyroscope and at least one accelerometer.

14. An aerosol-generating device comprising:

a receptacle configured to receive an aerosol-generating substrate;

electrical components comprising:

a heating element configured to heat the aerosol-generating substrate; and a power supply operably coupled to the heating element;

a vessel comprising an interior configured to contain liquid, wherein the vessel is positioned below the receptacle when the device is upright;

a controller;

a conduit in fluid communication with the vessel and the receptacle;

a valve positioned between the conduit and an airflow outlet of the receptacle, wherein the valve is configured to prevent egress of liquid from the interior of the vessel through the valve, wherein moving the aerosol-generating device to a vertical position causes the valve to open itself and the vessel to be in fluid communication with the receptacle, and wherein moving the aerosol-generating device to a tilted position causes the valve to close itself and to close fluid communication between the vessel and the receptacle; and a tilt sensor configured to sense a tilt of the device and to send a signal to the controller, when tilting is sensed;

wherein the controller is configured to receive the signal from the tilt sensor and to control the electrical components in response to the signal.

15. The aerosol-generating device according to claim 14, wherein the controller is configured to shut off power to the heating element in response to the signal.

16. The aerosol-generating device according to claim 14, wherein the tilt sensor comprises:

an emitter to emit an electromagnetic beam;

a detector to detect the electromagnetic beam; and a blocking member configured to block the electromagnetic beam when the device is tilted.

17. The aerosol-generating device according to claim 14, wherein the tilt sensor comprises:

at least one gyroscope;

at least one accelerometer; or at least one gyroscope and at least one accelerometer.

18. A method for using an aerosol-generating device, the device comprising:

a receptacle comprising an aerosol-generating substrate;

electrical components comprising:

a heating element configured to heat the aerosol-generating substrate; and a power supply operably coupled to the heating element;

a vessel comprising an interior containing liquid, wherein the vessel is positioned below the receptacle when the device is upright;

a tilt sensor configured to sense a tilt of the device;

a conduit in fluid communication with the vessel and the receptacle;

a valve positioned between the conduit and an airflow outlet of the receptacle, wherein the valve is configured to prevent egress of liquid from the interior of the vessel through the valve, wherein moving the aerosol-generating device to a vertical position causes the valve to open itself and the vessel to be in fluid communication with the receptacle, and wherein moving the aerosol-generating device to a tilted position causes the valve to close itself and to close fluid communication between the vessel and the receptacle; and a controller operably coupled to the tilt sensor and the electrical components;

the method comprising:

receiving a signal from the tilt sensor indicating that the device is tilted; and shutting off one or more of the electrical components in response to the signal.

* * * * *